US005752818A

United States Patent [19]

Forster

[11] Patent Number: 5,752,818

[45] Date of Patent: May 19, 1998

[54] CARBON MONOXIDE DETECTION AND AUTOMATIC DEACTIVATION SYSTEM

[76] Inventor: James Andrew Forster, 138 Bucks Road, Douglas, British Isles, Isle of Man

[21] Appl. No.: 607,994

[22] Filed: Mar. 4, 1996

[51] Int. Cl.[6] ..... F23N 5/00

[52] U.S. Cl. ..... 431/76; 431/48; 431/59; 431/75; 126/116 A; 126/92 AC

[58] Field of Search ..... 431/22, 76, 48, 431/59, 75; 126/116 A, 92 AC, 92 R

[56] References Cited

U.S. PATENT DOCUMENTS

| | | | |
|---|---|---|---|
| 4,638,789 | 1/1987 | Ueki et al. | 431/76 X |
| 5,160,259 | 11/1992 | O'Hara et al. | 431/76 X |
| 5,165,883 | 11/1992 | Van Bemmel | 431/76 X |
| 5,397,233 | 3/1995 | Eavenson et al. | 431/76 X |

*Primary Examiner*—Larry Jones

[57] ABSTRACT

A carbon monoxide detection and automatic deactivation system including a fuel burner having a fuel supply conduit coupled thereto. A pilot igniter is situated adjacent to a pilot supply conduit and is adapted to provide a flame in an interior space of the burner upon the actuation thereof. A thermocouple is positioned adjacent to the pilot igniter for producing an electric current upon the detection of heat. Also included is an electromechanical fuel valve comprising a solenoid adapted to allow the supply of fuel to the burner upon the receipt of current via the thermocouple and further preclude said supply upon the lack thereof. Finally, a switch mechanism is electrically coupled between the thermocouple and the solenoid. The switch mechanism has a first orientation for allowing current to pass therebetween with the absence of carbon monoxide and a second orientation for precluding current to pass therebetween with the presence of carbon monoxide.

5 Claims, 3 Drawing Sheets

CARBON MONOXIDE DETECTION AND AUTOMATIC DEACTIVATION SYSTEM

BACKGROUND OF THE INVENTION

1. Field of the Invention

The present invention relates to a carbon monoxide detection and automatic deactivation system and more particularly pertains to preventing dangerous levels of carbon monoxide within an inhabitance by effecting the deactivation of a faulty appliance.

2. Description of the Prior Art

The use of carbon monoxide detectors is known in the prior art. More specifically, carbon monoxide detectors heretofore devised and utilized for the purpose of indicating the presence of carbon monoxide are known to consist basically of familiar, expected and obvious structural configurations, notwithstanding the myriad of designs encompassed by the crowded prior art which have been developed for the fulfillment of countless objectives and requirements.

In this respect, the carbon monoxide detection and automatic deactivation system according to the present invention substantially departs from the conventional concepts and designs of the prior art, and in so doing provides an apparatus primarily developed for the purpose of preventing dangerous levels of carbon monoxide within an inhabitance by effecting the deactivation of a faulty appliance.

Therefore, it can be appreciated that there exists a continuing need for a new and improved carbon monoxide detection and automatic deactivation system which can be used for preventing dangerous levels of carbon monoxide within an inhabitance by effecting the deactivation of a faulty appliance. In this regard, the present invention substantially fulfills this need.

SUMMARY OF THE INVENTION

In view of the foregoing disadvantages inherent in the known types of carbon monoxide detectors now present in the prior art, the present invention provides an improved carbon monoxide detection and automatic deactivation system. As such, the general purpose of the present invention, which will be described subsequently in greater detail, is to provide a new and improved carbon monoxide detection and automatic deactivation system which has all the advantages of the prior art and none of the disadvantages.

To attain this, the present invention essentially comprises a fuel burner with a generally rectangular configuration having a supply conduit coupled adjacent to a first side thereof. A pilot conduit is situated adjacent to a second side of the fuel burner. Also included is a pilot igniter situated adjacent to the pilot conduit and adapted to provide a flame in an interior space of the burner upon the actuation thereof. A thermocouple is positioned adjacent to the pilot igniter for producing an electric current upon the detection of heat. As shown in FIG. 2, an electromechanical fuel valve has a top surface, a bottom surface, a front face, a rear face, and a pair of side edges formed therebetween defining an interior space. The fuel valve comprises an upper chamber with a fuel inlet for accepting fuel and a lower chamber with a fuel outlet coupled to the fuel supply conduit. The lower chamber is separated from the upper chamber by a divider. The divider has an aperture with a vertical orientation formed therein for allowing communication between the upper chamber and lower chamber. The combination of the aperture and divider thus defines an intermediate chamber. A channel with a horizonal orientation is integrally formed within the divider between the pilot conduit and the intermediate chamber for allowing communication therebetween. Also included is a main valve situated within the upper chamber including a valve assembly with a flow interrupter for precluding communication between the upper chamber and the intermediate chamber in a closed orientation. A rod is coupled to the flow interrupter and is extended upwardly therefrom. An armature is coupled to a top end of the rod. Further included is an electromagnet coupled to the top surface of the fuel valve adjacent to the armature. When the main valve is in a closed orientation, a space is present between the armature and electromagnet. The electromagnet is adapted to maintain the valve in an open orientation upon the actuation thereof, thereby allowing communication between the upper chamber and intermediate chamber. For maintaining the main valve in a closed orientation upon the deactivation of the electromagnet, a spring is situated about the rod. A spring biased reset button is situated on the bottom surface of the fuel valve with a vertical orientation. The reset button includes a flow interrupter having a closed orientation for precluding communication between the intermediate and lower chamber upon the depression of the button. Upon the depression of the reset button, an actuator rod is adapted to extend through the intermediate chamber and abut the flow interrupter of the valve assembly. The flow interrupter of the valve assembly thus is forced into an open orientation wherein communication between the upper chamber and intermediate chamber is allowed and the flow interrupter of the reset button is forced into a closed orientation thus precluding the supply of fuel to the main supply conduit, thereby allowing the supply of fuel to the pilot conduit from the fuel inlet. Also included is a control panel comprising a piezo spark generator connected to the pilot igniter. The spark generator is adapted to allow the actuation of the pilot igniter upon the activation thereof so as to activate the burner upon the simultaneous activation of the spark generator and depression of the reset button. As shown in FIGS. 1& 3, a carbon monoxide detector switch comprises a first terminal and a second terminal with a carbon monoxide detector electrically connected therebetween. The carbon monoxide detector switch has a first orientation for allowing current to pass therebetween with the absence of carbon monoxide and a second orientation for precluding current to pass therebetween with the presence of carbon monoxide.

Finally, as best shown in FIGS. 4 & 5, a universal interrupter is situated on the top surface of the fuel valve and comprises a conductive main body with a generally U-shaped configuration. The main body has a bottom surface with a pair of side faces integrally coupled thereto and extended upwardly therefrom. A main aperture is centrally formed on the bottom surface and a threaded bore is formed on an upper extent of each side face. The universal interrupter further includes an insulative spacer with a generally U-shaped configuration having a bottom surface with a pair of side faces integrally coupled thereto. An aperture is centrally formed on the bottom surface thereof. The insulative spacer is adapted to reside between the side faces of the main body with the main aperture axially aligned with the aperture thereof. Further included as part of the universal interrupter is a conductive securement plate with a rectangular configuration and a threaded bore centrally formed therein. The conductive securement plate is adapted to reside between the side faces of the insulative spacer with the threaded bore axially aligned with the main aperture. For providing a connection between the universal interrupter and the carbon monoxide detector, an insulative interceptor block is included with a rectangular configuration having a top face, a bottom face, and a periphery. The insulative interceptor block has a first conductive strip electrically connected to the first terminal of the carbon monoxide detector. The first conductive strip is longitudinally situated within a lower extent of the interceptor plate with a portion of the strip extending from the periphery thereof. A second conductive strip is electrically connected to the second terminal of the carbon monoxide detector and longitudinally situated within an upper extent of the interceptor plate. A portion of the second strip extends from the periphery of the interceptor plate adjacent to the first conductive strip with a space situated therebetween. For allowing communication with the first conductive strip from the bottom surface thereof, the interceptor plate includes a first bore is centrally formed on the bottom face thereof and axially aligned with the main aperture. A second bore is centrally formed on the top face thereof for allowing communication with the second conductive strip from the top face of the interceptor plate. The universal interrupter further includes a rectangular top plate with a cylindrical protrusion extending upwardly therefrom with a threaded conical interior and an aperture centrally formed therein. Such a structure allows mechanical and electrical coupling with the thermocouple. The rectangular top plate is situated on the top surface of the interceptor plate with a pair of coupling apertures formed therein. A plurality of coupling screws are included for removably inserting within the coupling apertures of the top plate and screwably coupling with the threaded bores of the main body. The coupling screws thus contain the insulative block, conductive securement plate, and interceptor plate in an operative orientation. For providing electrical communication between the thermocouple and the electromagnet, a conductive bolt is included with an insulative cover having a tubular configuration. The cover includes an annular flange situated on a lower end thereof. The cover is adapted to secure about the bolt wherein a threaded portion of the bolt extends above the cover and is screwably coupled with the threaded bore of the conductive securement plate when inserted within the axially aligned bores. Coupling the universal interrupter and the fuel valve is a conductive securement nut connected to ground and situated about the insulative cover between the bottom surface of the main body and the flange of the cover. The conductive securement nut has a top portion with a hexagonal configuration and a lower portion with a threaded outer surface which is screwably coupled to the fuel valve. The bolt and the securement nut are electrically connected to the electromagnet. The bolt is configured such that, when the burner is activated, the current transmitted via the thermocouple activates the electromagnet thus allowing continued operation of the burner. Upon the detection of carbon monoxide, the carbon monoxide detector precludes such current and the electromagnet deactivates thus deactivating the burner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved carbon monoxide detection and automatic deactivation system which has all the advantages of the prior art carbon monoxide detectors and none of the disadvantages.

It is another object of the present invention to provide a new and improved carbon monoxide detection and automatic deactivation system which may be easily and efficiently manufactured and marketed.

It is a further object of the present invention to provide a new and improved carbon monoxide detection and automatic deactivation system which is of a durable and reliable construction.

An even further object of the present invention is to provide a new and improved carbon monoxide detection and automatic deactivation system which is susceptible of a low cost of manufacture with regard to both materials and labor, and which accordingly is then susceptible of low prices of sale to the consuming public, thereby making such carbon monoxide detection and automatic deactivation system economically available to the buying public.

Still yet another object of the present invention is to provide a new and improved carbon monoxide detection and automatic deactivation system which provides in the apparatuses and methods of the prior art some of the advantages thereof, while simultaneously overcoming some of the disadvantages normally associated therewith.

Still another object of the present invention is to prevent dangerous levels of carbon monoxide within an inhabitance resulting from the faulty operation of an appliance by effecting the deactivation thereof.

It is another object of the present invention to provide a highly reliable, sensitive, fail safe means of detecting carbon monoxide produced by an appliance without dependence on an outside source of power.

Still yet another object of the present invention is to allow the use thereof with a plurality of types of thermocouple.

It is also an object of the present invention to allow remote positioning of the carbon monoxide detector.

Lastly, it is an object of the present invention to provide a new and improved carbon monoxide detection and automatic deactivation system including a fuel burner having a fuel supply conduit coupled thereto. A pilot igniter is situated adjacent to a pilot supply conduit and is adapted to provide a flame in an interior space of the burner upon the actuation thereof. A thermocouple is positioned adjacent to the pilot igniter for producing an electric current upon the detection of heat. Also included is an electromechanical fuel valve comprising a solenoid adapted to allow the supply of fuel to the burner upon the receipt of current via the thermocouple and further preclude said supply upon the lack thereof. Finally, a switch mechanism is electrically coupled between the thermocouple and the solenoid. The switch mechanism has a first orientation for allowing current to pass therebetween with the absence of carbon monoxide and a second orientation for precluding current to pass therebetween with the presence of carbon monoxide.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
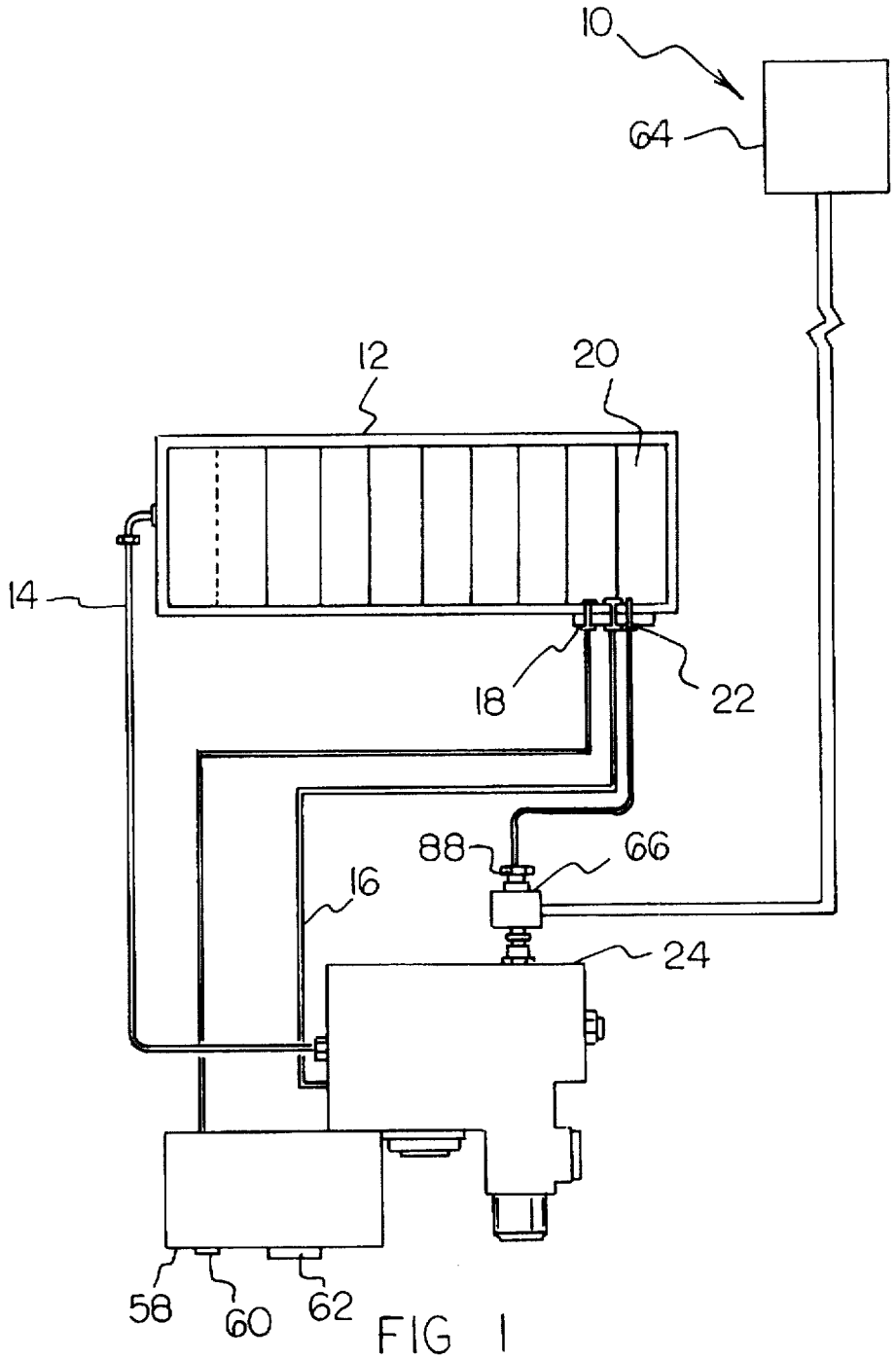
FIG. 1 is a plan illustration of the preferred embodiment of the carbon monoxide detection and automatic deactivation system constructed in accordance with the principles of the present invention.

With reference now to the drawings, and in particular to FIG. 1 thereof, a new and improved carbon monoxide detection and automatic deactivation system embodying the principles and concepts of the present invention and generally designated by the reference numeral 10 will be described.

The present invention, the new and improved carbon monoxide detection and automatic deactivation system, is comprised of a plurality of components. Such components in their broadest context include a fuel burner, an electromechanical fuel valve, a control panel, carbon monoxide detector switch, and a universal interrupter. Such components are individually configured and correlated with respect to each other so as to attain the desired objective.

More specifically, it will be noted that the system 10 of the present invention includes a fuel burner 12 with a generally rectangular configuration having a supply conduit 14 coupled adjacent to a first side thereof. A pilot conduit 16 is situated adjacent to a second side of the fuel burner. Also included is a pilot igniter 18 situated adjacent to the pilot conduit and adapted to provide a flame in an interior space 20 of the burner upon the actuation thereof. A thermocouple 22 is situated adjacent to the pilot igniter for producing an electric current upon the detection of heat.

Figure 2:
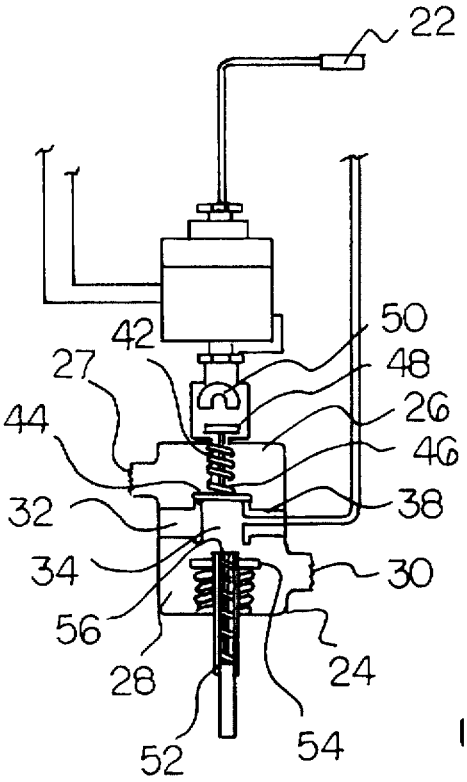
FIG. 2 is a cross-sectional view of the main valve of the present invention.

As shown in FIG. 2, an electromechanical fuel valve 24 has a top surface, a bottom surface, a front face, a rear face, and a pair of side edges formed therebetween defining an interior space. The fuel valve comprises an upper chamber 26 with a fuel inlet 27 for accepting fuel and a lower chamber 28 with a fuel outlet 30 coupled to the fuel supply conduit. The lower chamber is separated from the upper chamber by a divider 32. The divider has an aperture 34 with a vertical orientation formed therein for allowing communication between the upper chamber and lower chamber. The combination of the aperture and divider thus defines an intermediate chamber. A channel 38 having a horizonal orientation is integrally formed within the divider between the pilot conduit and the intermediate chamber for allowing communication therebetween. Also included is a main valve situated within the upper chamber including a valve assembly 42 with a flow interrupter 44 for precluding communication between the upper chamber and the intermediate chamber in a closed orientation. A rod 46 is coupled to the flow interrupter and is extended upwardly therefrom. An armature 48 is coupled to a top end of the rod. Further included is an electromagnet 50 coupled to the top surface of the fuel valve adjacent to the armature. When the main valve is in a closed orientation, a space is present between the armature and electromagnet. The electromagnet is adapted to maintain the valve in an open orientation upon the actuation thereof thereby allowing communication between the upper chamber and intermediate chamber. For maintaining the main valve in a closed orientation upon the deactivation of the electromagnet, a spring is situated about the rod and biased between the top surface of the main valve and the flow interrupter thereof. A spring biased reset button 52 is situated on the bottom surface of the fuel valve with a vertical orientation. The reset button includes a flow interrupter 54 having a closed orientation for precluding communication between the intermediate and lower chamber upon the depression of the button. Upon the depression of the reset button, an actuator rod 56 is adapted to extend through the intermediate chamber and abut the flow interrupter of the valve assembly. The flow interrupter of the valve assembly thus is forced into an open orientation wherein communication between the upper chamber and intermediate chamber is allowed and the flow interrupter of the reset button is forced into a closed orientation thus precluding the supply of fuel to the main supply conduit and allowing the supply of fuel to the pilot conduit from the fuel inlet.

Also included is a control panel 58 comprising a piezo spark generator 60 connected to the pilot igniter. The spark generator is adapted to allow the actuation of the pilot igniter upon the activation thereof so as to activate the burner upon the simultaneous activation of the spark generator and depression of the reset button. Optionally, a thermostat 62 is included for controlling the amount of gas supplied to the burner.

Figure 3:
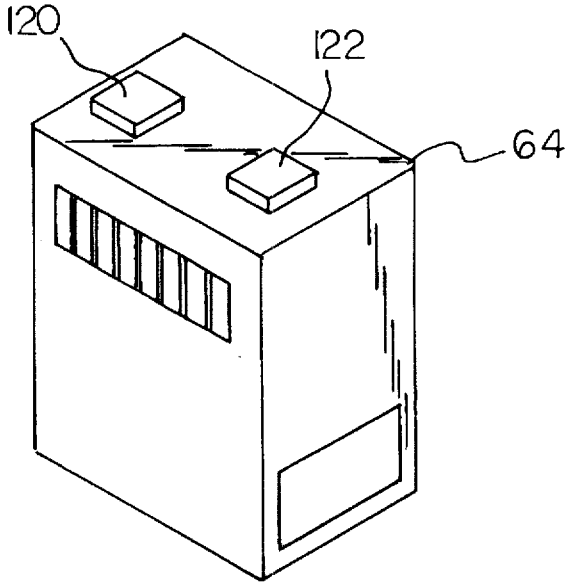
FIG. 3 is a perspective view of the carbon monoxide detector employed by the present invention.

As shown in FIGS. 1& 3, a carbon monoxide detector 64 switch comprises a first terminal and a second terminal with a carbon monoxide detector electrically connected therebetween. Ideally, the detector consists of a Figaro Carbon Monoxide sensor type TGS 203, TGS 2440 or other ones utilizing integrated circuits. Powering of the detector is preferably effected by an alternating current receptacle, battery, or a combination thereof. The carbon monoxide detector switch has a first orientation for allowing current to pass therebetween with the absence of carbon monoxide and a second orientation for precluding current to pass therebetween with the presence of carbon monoxide.

Figure 5:
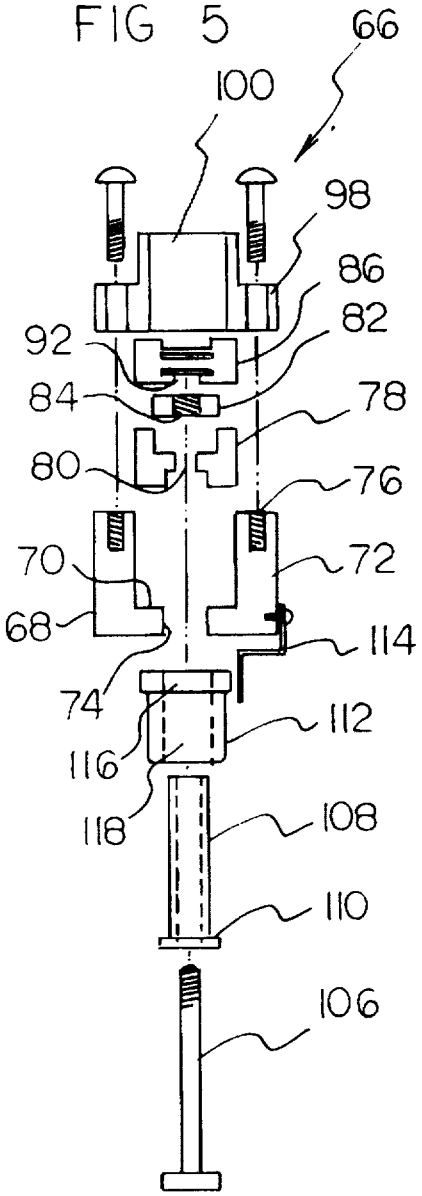
FIG. 5 is a cross-sectional view of the universal interrupter shown in FIG. 4.
Figure 4:
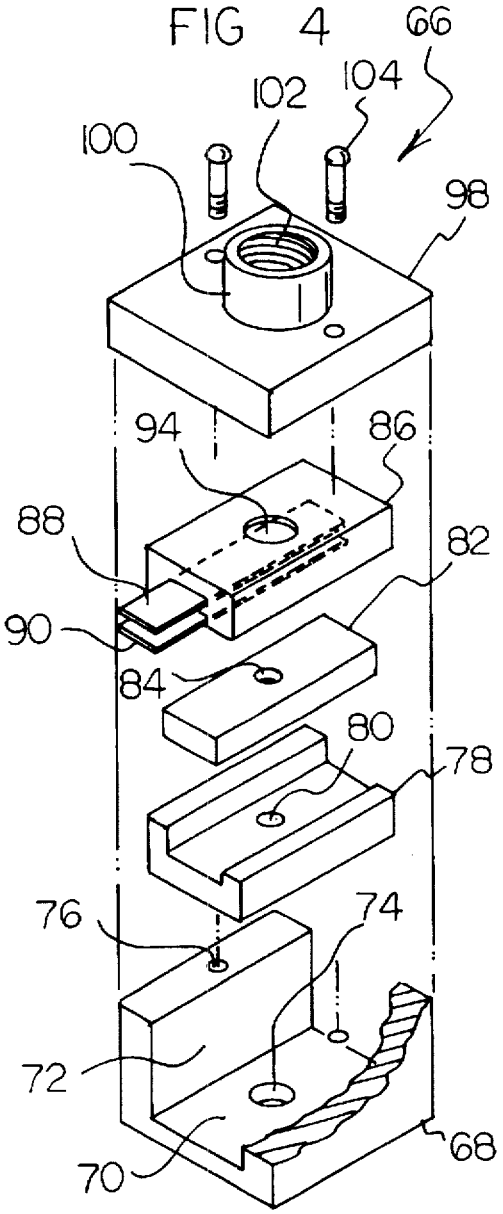
FIG. 4 is a perspective view of the universal interrupter in a disassembled orientation.

Finally, as best shown in FIGS. 4 & 5, a universal interrupter 66 is situated on the top surface of the fuel valve and comprises a conductive main body 68 with a generally U-shaped configuration. The main body has a bottom surface 70 with a pair of side faces 72 integrally coupled thereto and extended upwardly therefrom. A main aperture 74 is centrally formed on the bottom surface and a threaded bore 76 is formed on an upper extent of each side face.

The universal interrupter further includes an insulative spacer 78 with a generally U-shaped configuration having a bottom surface with a pair of side faces integrally coupled thereto and extended upwardly therefrom. An aperture 80 is centrally formed on the bottom surface thereof. The insulative spacer is adapted to reside between the side faces of the main body with the main aperture axially aligned with the aperture thereof.

Further included as part of the universal interrupter is a conductive securement plate 82 with a rectangular configuration and a threaded bore 84 centrally formed therein. The conductive securement plate is adapted to reside between the side faces of the insulative spacer with the threaded bore axially aligned with the main aperture.

For providing a connection between the universal interrupter and the carbon monoxide detector, an insulative interceptor block 86 is included with a rectangular configuration having a top face, a bottom face, and a periphery. The insulative interceptor block has a first conductive strip 88 electrically connected to the first terminal of the carbon monoxide detector. The first conductive strip is longitudinally situated within a lower extent of the interceptor plate with a portion of the first strip extending from the periphery thereof. A second conductive strip 90 is electrically connected to the second terminal of the carbon monoxide detector and longitudinally situated within an upper extent of the interceptor plate. A portion of the second strip extends from the periphery of the interceptor plate adjacent to the first conductive strip with a space situated therebetween. For allowing communication with the first conductive strip from the bottom surface thereof, the interceptor plate includes a first bore is 92 centrally formed on the bottom face thereof and axially aligned with the main aperture. A second bore 94 is centrally formed on the top face thereof for allowing communication with the second conductive strip from the top face.

The universal interrupter further includes a rectangular top plate 98 with a cylindrical protrusion 100 extending upwardly therefrom with a threaded conical interior 102 and an aperture centrally formed therein. Such a structure allows mechanical and electrical coupling with the thermocouple. The rectangular top plate is situated on the top surface of the interceptor plate with a pair of coupling apertures formed therein. The top plate is suitably replaceable to accommodate any one of a plurality of various thermocouples.

A plurality of coupling screws 104 are included for removably inserting within the coupling apertures of the top plate and screwably coupling with the threaded bores of the main body. The coupling screws thus contain the insulative block, conductive securement plate, and interceptor plate in an operative orientation.

For providing electrical communication between the thermocouple and the electromagnet, a conductive bolt 106 is included with an insulative cover 108 having a tubular configuration. The cover includes an annular flange 110 situated on a lower end thereof. The cover is adapted to secure about the bolt wherein a threaded portion of the bolt extends above the cover and is screwably coupled with the threaded bore of the conductive securement plate.

Coupling the universal interrupter and the fuel valve is a conductive securement nut 112 connected to ground and situated about the insulative cover between the bottom surface of the main body and flange of the cover. An earth tag 114 including a strip of metal is connected between the main body and the securement nut to facilitate the connection to ground. The securement nut has a top portion 116 with a hexagonal configuration and a lower portion with a threaded outer surface 118 which is screwably coupled to the fuel valve.

The bolt and the securement nut are electrically connected to the electromagnet. The bolt is configured such that, when the burner is activated, the current transmitted via the thermocouple activates the electromagnet thus allowing continued operation of the burner. Upon the detection of carbon monoxide, the carbon monoxide detector precludes such current and the electromagnet deactivates, thereby deactivating the burner.

As an option, the carbon monoxide detector may comprise a reset button 120 for manually providing a short between the first terminal and second terminal thus allowing testing of the burner. Also, a test button 122 may also b e included for providing an open circuit therebetween for allowing testing of the universal interrupter.

In use, the reset button at the base of the fuel valve is pressed upwards and the flow interrupter thereof is moved onto the divider thus sealing the fuel supply conduit. Further insertion of the reset button raises the flow interrupter of the main valve which allows gas to flow to the pilot conduit so that the pilot igniter may be lit. The current generated by the temperature of the thermocouple is intercepted by the universal interrupter such that it passes up the top conductive strip thereof to the detection unit and returns via the bottom conductive strip thereby allowing the electromagnet to energize. Such energization holds the armature and the associated flow interrupter in an open orientation. At this stage, the reset button is released and the reset button spring forces it and the associated flow interrupter downwards thus opening the fuel supply conduit and allowing fuel flow to the burner. If carbon monoxide becomes present above safe levels, the detector interrupts the flow of current to the electromagnet by precluding the flow of current thereto. The flow interrupter of the valve assembly, biased by the spring, returns to a closed orientation thus deactivating the burner.

In an alternate embodiment wherein a plurality of fuel burners exist which are supplied by a single supply conduit, a valve is adapted to preclude fuel from flowing to all of the fuel burners upon the actuation thereof. In such an embodiment, a single carbon monoxide detector is included for activating the valve upon the detection of carbon monoxide.

Further, in another alternate embodiment wherein a plurality of fuel burners exist which are each supplied by a separate supply conduit, a plurality of valves each associated with a single fuel burner are adapted to preclude fuel from flowing to the associated fuel burner upon the actuation thereof. In this embodiment, a plurality of carbon monoxide detectors are situated adjacent to each boiler for activating solely a valve associated with a faulty fuel burner upon the detection of carbon monoxide in the proximity thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the united states is as follows:

1. A new and improved carbon monoxide detection and automatic deactivation system comprising, in combination:

a fuel burner with a generally rectangular configuration having a supply conduit coupled adjacent to a first side thereof, a pilot conduit situated adjacent to a second side thereof, a pilot igniter situated adjacent to the pilot conduit and adapted to provide a flame in an interior space of the burner upon the actuation thereof, and a thermocouple situated adjacent to the pilot igniter for producing an electric current upon the detection of heat;

an electromechanical fuel valve having a top surface, a bottom surface, a front face, a rear face, and a pair of side edges formed therebetween defining an interior space, the fuel valve comprising an upper chamber with a fuel inlet accepting fuel; a lower chamber with a fuel outlet coupled to the fuel supply conduit, the lower chamber separated from the upper chamber by a divider having an aperture with a vertical orientation formed therein for allowing communication between the upper chamber and lower chamber thus defining an intermediate chamber and a channel with a horizonal orientation integrally formed within the divider between the pilot conduit and the intermediate chamber for allowing communication therebetween; a main valve situated within the upper chamber including a valve assembly with a flow interrupter for precluding communication between the upper chamber and the intermediate chamber in a closed orientation with a rod coupled thereto and extending upwardly therefrom with an armature coupled to a top end of the rod; an electromagnet coupled to the top surface adjacent to the armature with a space situated therebetween when the main valve is in a closed orientation, the electromagnet adapted to maintain the valve in an open orientation upon the actuation thereof thereby allowing communication between the upper chamber and intermediate chamber; a spring situated about the rod for maintaining the main valve in a closed orientation upon the deactivation of the electromagnet; a spring biased reset button with a vertical orientation situated on the bottom surface of the fuel valve, the reset button including a flow interrupter having a closed orientation for precluding communication between the intermediate and the lower chamber upon the depression of the button and an open orientation for allowing such communication; and an actuator rod adapted to extend through the intermediate chamber and abut the flow interrupter of the valve assembly upon the depression of the reset button, whereby the flow interrupter of the valve assembly is forced into an open orientation wherein communication between the upper chamber and intermediate chamber is allowed and the flow interrupter of the reset button is forced into a closed orientation thus precluding the supply of fuel to the main supply conduit and allowing the supply of fuel to the pilot conduit from the fuel inlet;

a control panel comprising a piezo spark generator connected to the pilot igniter and adapted to allow the actuation thereof so as to activate the burner upon the simultaneous activation of the spark generator and depression of the reset button;

a carbon monoxide detector switch comprising a first terminal and a second terminal with a carbon monoxide detector electrically connected therebetween with a first orientation for allowing current to pass therebetween with the absence of carbon monoxide and a second orientation for precluding current to pass therebetween with the presence of carbon monoxide; and a universal interrupter situated on the top surface of the fuel valve and comprising:

a conductive main body with a generally U-shaped configuration having a bottom surface with a pair of side faces integrally coupled thereto and extending upwardly therefrom, the main body having a main aperture centrally formed on the bottom surface and a threaded bore formed on an upper extent of each side face, an insulative spacer with a generally U-shaped configuration having a bottom surface with a pair of side faces integrally coupled thereto and extending upwardly therefrom with an aperture centrally formed on the bottom surface thereof, whereby the insulative spacer is adapted to reside between the side faces of the main body with the main aperture axially aligned with the aperture thereof, a conductive securement plate with a rectangular configuration and a threaded bore centrally formed therein, the conductive securement plate adapted to reside between the side faces of the insulative spacer with the threaded bore axially aligned with the main aperture, an insulative interceptor block with a rectangular configuration having a top face, a bottom face, and a periphery, the insulative interceptor block having a first conductive strip electrically connected to the first terminal of the carbon monoxide detector and longitudinally situated within a lower extent thereof with a portion of the strip extending from the periphery of the interceptor plate, a second conductive strip electrically connected to the second terminal of the carbon monoxide detector and longitudinally situated within an upper extent thereof with a portion of the strip extending from the periphery of the interceptor plate adjacent to the first conductive strip with a space situated therebetween, a first bore centrally formed on the bottom face thereof and axially aligned with the main aperture for allowing communication with the first conductive strip from the bottom surface thereof, and a second bore centrally formed on the top face thereof for allowing communication with the second conductive strip from the top face thereof, a rectangular top plate with a cylindrical protrusion extending upwardly therefrom with a threaded conical interior and an aperture centrally formed therein for mechanical and electrical coupling with the thermocouple, the rectangular top plate situated on the top surface of the interceptor plate with a pair of coupling apertures formed therein, coupling screws for removably inserting within the coupling apertures of the top plate and screwably coupling with the threaded bores of the main body for containing the insulative block, conductive securement plate, and interceptor plate in an operative orientation, a conductive bolt with an insulative cover having a tubular configuration with an annular flange situated on a lower end thereof adapted to secure about the bolt wherein a threaded portion of the bolt extends above the cover and is screwably coupled with the threaded bore of the conductive securement plate, and a conductive securement nut connected to ground and situated about the insulative cover between the bottom surface of the main body and the flange of the insulative cover, the conductive securement plate having a top portion with a hexagonal configuration and a lower portion with a threaded outer surface which is screwably coupled to the fuel valve;

whereby the bolt and the securement nut are electrically connected to the electromagnet such that when the burner is activated the current transmitted via the thermocouple activates the electromagnet thus allowing continued operation of the burner and upon the detection of carbon monoxide, the carbon monoxide detector precludes such current and the electromagnet deactivates thus deactivating the burner.

2. A toxic gas detection and automatic deactivation system comprising:

a fuel burner having a supply conduit, a pilot conduit, a pilot igniter situated adjacent to the pilot conduit and adapted to provided a flame in an interior space of the burner upon the actuation thereof, and a thermocouple situated adjacent to the pilot igniter for producing an electric current upon the detection of heat;

an electromechanical fuel valve comprising an solenoidal means adapted to allow the supply of fuel to the burner upon the receipt of current via the thermocouple and further preclude said supply upon the lack thereof; and switch means electrically coupled between the thermocouple and the solenoidal means, the switch means having a first orientation for allowing current to pass therebetween with the absence of a toxic gas and a second orientation for precluding current to pass therebetween with the presence of toxic gas;

wherein the switch means comprises:

a toxic gas detector switch comprising a first terminal and a second terminal with a toxic gas detector electrically connected therebetween with a first orientation for allowing current to pass therebetween with the absence of toxic gas and a second orientation for precluding current to pass therebetween with the presence of toxic gas; and a universal interrupter comprising:

a conductive main body with a generally U-shaped configuration having a bottom surface with a pair of side faces integrally coupled thereto and extending upwardly therefrom, the main body having a main aperture centrally formed on the bottom surface and a threaded bore formed on an upper extent of each side face, an insulative spacer with a generally U-shaped configuration having a bottom surface with a pair of side faces integrally coupled thereto and extending upwardly therefrom with an aperture centrally formed on the bottom surface thereof, whereby the insulative spacer is adapted to reside between the side faces of the main body with the main aperture axially aligned with the aperture thereof, a conductive securement plate with a rectangular configuration and a threaded bore centrally formed therein, the conductive securement plate adapted to reside between the side faces of the insulative spacer with the threaded bore axially aligned with the main aperture, an insulative interceptor block with a rectangular configuration having a top face, a bottom face, and a periphery, the insulative interceptor block having a first conductive strip electrically connected to the first terminal of the toxic gas detector and longitudinally situated within a lower extent thereof with a portion of the strip extending from the periphery of the interceptor plate, a second conductive strip electrically connected to the second terminal of the toxic gas detector and longitudinally situated within an upper extent thereof with a portion of the strip extending from the periphery of the interceptor plate adjacent to the first conductive strip with a space situated therebetween, a first bore centrally formed on the bottom face thereof and axially aligned with the main aperture for allowing communication with the first conductive strip from the bottom surface thereof, and a second bore centrally formed on the top face thereof for allowing communication with the second conductive strip from the top face thereof, a rectangular top plate with a cylindrical protrusion extending upwardly therefrom with a threaded conical interior and an aperture centrally formed therein for mechanical and electrical coupling with the thermocouple, the rectangular top plate situated on the top surface of the interceptor plate with a pair of coupling apertures formed therein, coupling screws for removably inserting within the coupling apertures of the top plate and screwably coupling with the threaded bores of the main body for containing the insulative block, conductive securement plate, and interceptor plate in an operative orientation, a conductive bolt with an insulative cover having a tubular configuration with an annular flange situated on a lower end thereof adapted to secure about the bolt wherein a threaded portion of the bolt extends above the cover and is screwably coupled with the threaded bore of the conductive securement plate, and a conductive securement nut connected to ground and situated about the insulative cover between the bottom surface of the main body and the flange of the insulative cover, the conductive securement nut having a top portion with a hexagonal configuration and a lower portion with a threaded outer surface which is screwably coupled to the fuel valve;

whereby the bolt and the securement nut are electrically connectd to the electromagnet means such that when the burner is activated the current transmitted via the thermocouple activates the electromagnet thus allowing continued operation of the burner and upon the detection of toxic gas, the toxic gas detector precludes such current and the electromagnet means deactivates thus deactivating the burner.

3. A toxic gas detection and automatic deactivation system as set forth in claim 2 wherein the toxic gas detector comprises a reset button for providing a short between the first terminal and second terminal for allowing testing of the burner and a test button for providing an open therebetween for allowing testing of the universal interrupter.

4. A toxic gas detection and automatic deactivation system comprising:

a fuel burner having a supply conduit, a pilot conduit, a pilot igniter situated adjacent to the pilot conduit and adapted to provide a flame in an interior space of the burner upon the actuation thereof, and a thermocouple situated adjacent to the pilot igniter for producing an electric current upon the detection of heat;

an electromechanical fuel valve comprising an solenoidal means adapted to allow the supply of fuel to the burner upon the receipt of current via the thermocouple and further preclude said supply upon the lack thereof; and switch means electrically coupled between the thermocouple and the solenoidal means, the switch means having a first orientation for allowing current to pass therebetween with the absence of a toxic gas and a second orientation for precluding current to pass therebetween with the presence of toxic gas;

wherein the fuel valve comprises a top surface, a bottom surface, a front face, a rear face, and a pair of side edges formed therebetween defining an interior space, the fuel valve comprising an upper chamber with a fuel inlet for accepting fuel; a lower chamber with a fuel outlet coupled to the fuel supply conduit, the lower chamber separated from the upper chamber by a divider having an aperture with a vertical orientation formed therein for allowing communication between the upper chamber and lower chamber thus defining an intermediate chamber and a channel with a horizonal orientation integrally formed within the divider between the pilot conduit and the intermediate chamber for allowing communication therebetween; a main valve situated within the upper chamber including a valve assembly with a flow interrupter for precluding communication between the upper chamber and the intermediate chamber in a closed orientation with a rod coupled thereto and extending upwardly therefrom with an armature coupled to a top end of the rod; an electromagnet coupled to the top surface adjacent to the armature with a space situated therebetween when the main valve is in a closed orientation, the electromagnet adapted to maintain the valve in an open orientation upon the actuation thereof thereby allowing communication between the upper chamber and intermediate chamber; a spring situated about the rod for maintaining the main valve in a closed orientation upon the deactivation of the electromagnet; a spring biased reset button with a vertical orientation situated on the bottom surface of the fuel valve, the reset button including a flow interrupter having a closed orientation for precluding communication between the intermediate and the lower chamber upon the depression of the button and an open orientation for allowing such communication and an actuator rod adapted to extend through the intermediate chamber and abut the flow interrupter of the valve assembly upon the depression of the reset button, whereby the flow interrupter of the valve assembly is forced into an open orientation wherein communication between the upper chamber and intermediate chamber is allowed and the flow in interrupter of the reset button is forced into a closed orientation thus precluding the supply of fuel to the main supply conduit and allowing the supply of fuel to the pilot conduit from the fuel inlet.

5. A toxic gas detection and automatic deactivation system as set forth in claim 4 and further comprising a control panel having a piezo spark generator connected to the pilot igniter and adapted to allow the actuation thereof so as to activate the burner upon the simultaneous activation of the spark generator and depression of the reset button.

* * * * *